United States Patent [19]

Boyles

[11] 4,171,471

[45] Oct. 16, 1979

[54] PROGRAMMABLE TIMER

[75] Inventor: Robert L. Boyles, Milford, Conn.

[73] Assignee: Timex Corporation, Waterbury, Conn.

[21] Appl. No.: 871,781

[22] Filed: Jan. 24, 1978

[51] Int. Cl.[2] ..... H01H 43/00

[52] U.S. Cl. ..... 200/38 D; 200/38 FB

[58] Field of Search ..... 200/35 R, 36, 37 R, 200/38 A, 38 FA, 38 FB, 38 D, 38 DA, 38 DB, 38 DC, 39 R, 38 F

[56] References Cited

U.S. PATENT DOCUMENTS

| | | | |
|---|---|---|---|
| 2,623,132 | 12/1952 | Everard | 200/39 R |
| 2,806,910 | 9/1957 | James, Jr. | 200/38 FB |
| 2,816,184 | 12/1957 | Manning et al. | 200/38 DA |
| 3,032,618 | 5/1962 | Johnson | 200/37 R X |
| 3,997,742 | 12/1976 | Marquis | 200/38 FB |
| 4,130,748 | 12/1978 | Schwer | 200/38 FB X |

*Primary Examiner*—James R. Scott

*Attorney, Agent, or Firm*—William C. Crutcher

[57] ABSTRACT

A programmable timer for selectively controlling the operation of a lamp or the like comprises a housing having a face plate with a plurality of movable buttons and engaging slots arrayed in a circle. A motor-driven shaft includes a cammed switching mechanism for engaging a spring contact switch. A spring biased bell crank activated by a selected button cams a lever operating the switch mechanism. A separate cam lever is provided to selectively override the automatic feature of the switch. The timer has a plug for a power source and a plug receptacle for receiving a lamp or other electrical device controlled by the cam-operated switch of the timer.

16 Claims, 9 Drawing Figures

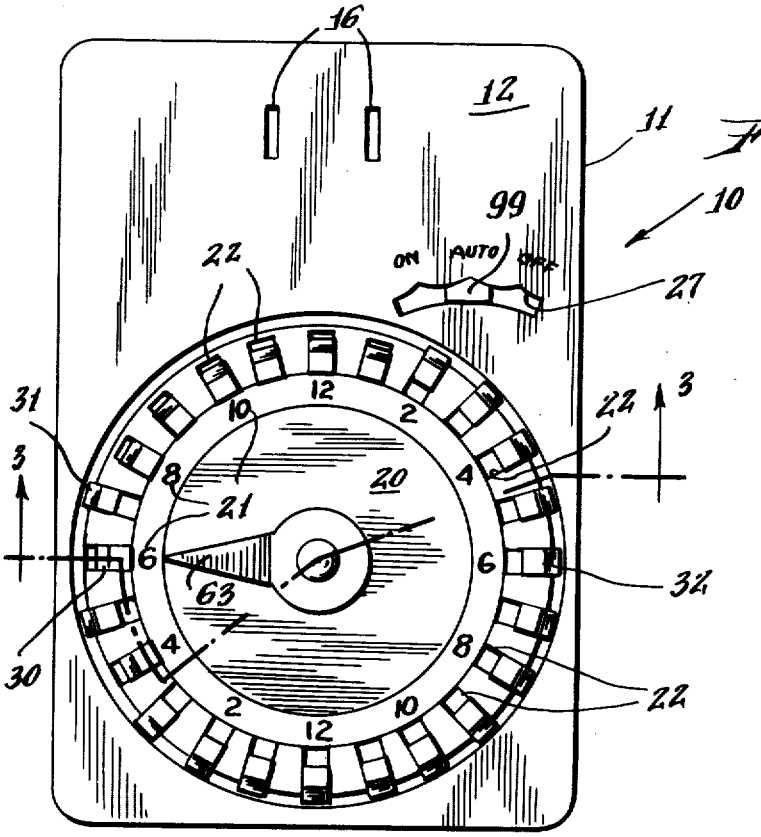
Fig. 1
Fig. 2.
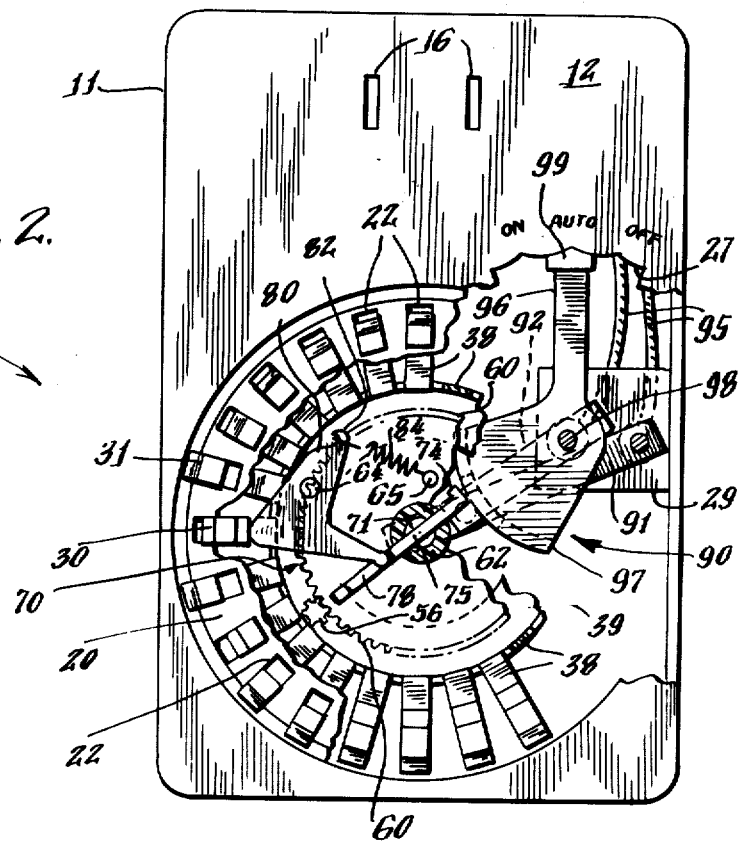

Fig. 3.
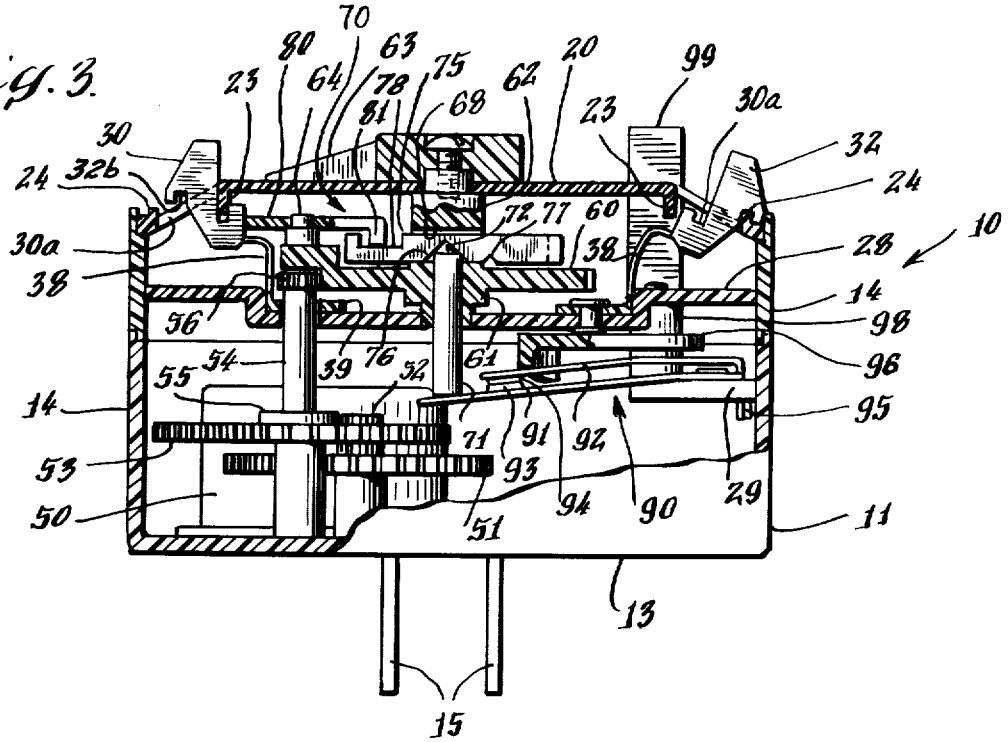
Fig. 4.
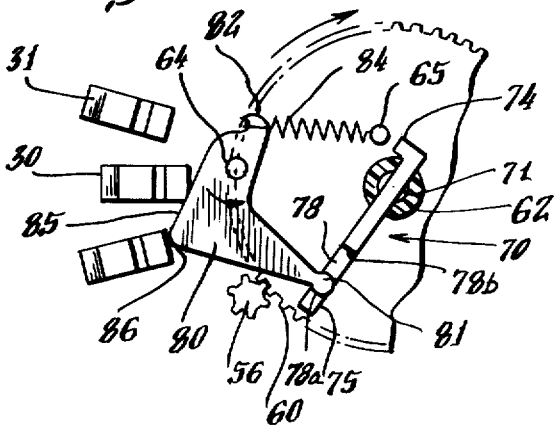
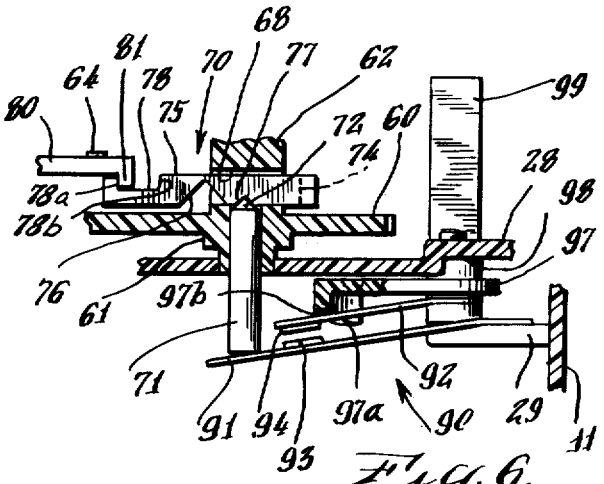
Fig. 6.
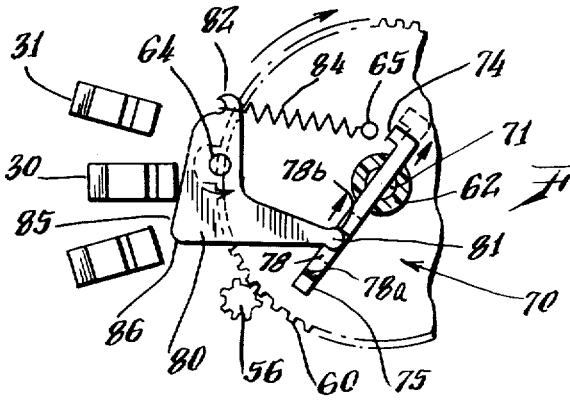
Fig. 5.

PROGRAMMABLE TIMER

BACKGROUND OF THE INVENTION

This invention relates to a programmable timer, and more particularly to a programmable timer which may be set to control, automatically, the operation of electrical devices a plurality of times during a twenty-four hour time interval.

It is desirable to be able to control the operation of electrical devices through the use of a timer which automatically switches the devices on and off at desired times. This is particularly important to home owners, who, when absent from their homes, desire that lights, radios or other appliances be turned on and off to simulate normal activities of the household. There are many other uses for such timers.

It is particularly desirable that the devices can be switched on and off more than once in a twenty-four hour period by the timer, and that the timer be easy to read and to set, i.e. that there be no confusion as to the time the device is to be turned on and off. It is further desirable that the transition between on and off be accomplished by a snap action switch means so that no chattering or arcing between the switch contacts occurs.

Prior art timers have been unable to achieve all of these desirable features in a low cost unit. One common prior art timer has a rotating dial with hour indicating indicia thereon. A stationary pointer indicates the time as the hour indicia pass thereby. Two levers are provided, one of the levers setting an on time and the other lever setting an off time. Thus, each time the dial rotates it turns the device controlled by the timer on and off once. This is disadvantageous, and a further disadvantage is that the rotating dial is difficult to read and to use in properly setting the on and off times at the desired time of day.

Other prior art timers are somewhat similar in structure, i.e. incorporating a rotating dial, but have additional pins or levers for setting more than one on/off cycle in a given twenty-four hour period. In one instance, the pins are removable from the rotating dial and stored separately from the dial unless in use for setting an on or off time.

One other pertinent prior art timer included a clock having a clock face, which is surrounded by a plurality of discreetly mounted push/pull pins. A lever rotating with the hour hand of the clock, but below it, contacted the pins and caused electrical contacts to close for turning a device on at the indicated time. The contacts were opened when the lever moved passed a pin set to on, and the lever further included a cam for automatically returning the pin to its off position. This mechanism was quite complex and costly to manufacture, and was used primarily in laboratories rather than in the homes, and is no longer being produced.

Therefore, there still exists a need for a low cost programmable timer which is easy to read and to set, and which will switch devices attached thereto between their on and off conditions a plurality of times, as selected, in a given twenty-four hour period, wherein the switching is accomplished in a positive snap action manner.

SUMMARY OF THE INVENTION

Accordingly, it is a principal object of the invention herein to provide a programmable timer which is easy to use.

It is an additional object of the invention herein to provide a programmable timer wherein the timer includes time-indicating indicia on a stationary face plate and a pointer which rotates to indicate the time.

It is a further object of the invention herein to provide a programmable timer which achieves a plurality of on/off cycles during a given timing period, as desired.

It is yet another object of the invention herein to provide a programmable timer which achieves the preceding objects of the invention and which is inexpensive to manufacture and rugged and reliable in use.

A programmable timer according to the invention herein comprises a housing having a fixed face plate with time indicating indicia arrayed thereabout. Adjacent to the hour indicating indicia are a plurality of buttons which are each selectively radially movable between and releasably latched in off and on positions. The plurality of buttons is preferably mounted to a single hub with each individual button connected thereto by a thin hinge finger, wherein the plurality of buttons, hinges and the hub can be molded and assembled into the programmable timer as one piece.

A shaft mounting a pointer is rotated by a motor within the housing, wherein the pointer indicates the time. A unique switch operating mechanism rotates with the shaft, contacting those buttons which are in the on position and closing switch contacts in a snap action manner to turn on the device controlled by the programmable timer for a period of time during which the switch mechanism rotates past the button. If the next adjacent button is in the on position, the switch mechanism maintains the switch contacts closed for an additional time period, but if the next adjacent button is in the off position, the switch operating mechanism opens the switch contacts in a snap action manner to turn the device controlled by the programmable timer off. In particular, the switch contacts are preferably provided on flexible spring switch blades, one of which has a free end disposed below the rotating shaft. A rod is axially received in the rotating shaft for up and down movement, which closes and opens the switch contacts. The up and down motion of the axially-received rod is achieved by means of a cam bar slideably mounted through the shaft and engaging the end of the rod opposite the switch blade. The cam bar has a deep notch portion receiving the rod in its up position closing the switch contacts and sliding the cam bar drives the rod out of the deep notch and downward to open the switch contacts. Sliding the cam bar the opposite direction permits the rod to seat in the deep notch and close the switch contacts in a snap action manner.

The cam bar is driven back and forth to operate the switch contacts by means of a bell crank which is rotatably mounted at a point spaced apart from the shaft and rotating with the shaft, i.e., about the axis of the shaft. The bell crank itself rotates as it engages a button in its on position, thereby driving the cam bar to permit the rod to slide upwardly into the deep notch and close the switch contacts in snap action manner. The bell crank stretches a spring as it rotates to close the switch contacts in the above described manner, and when the bell crank disengages from the button in its on position (after a period of time while the bell crank passes the button), the stretched spring rapidly rotates the bell crank in the opposite direction, thereby driving the cam bar to cam the rod from the deep notch and downwardly to open the switch contacts in snap action manner.

The programmable timer includes a male plug or other contact means for connecting it to a source of power and a female plug receptacle or other means for attaching the device or devices to be controlled by the programmable timer thereto, such that when the contacts are made or broken, the device controlled by the programmable timer is turned on or off. The motor driving the programmable timer may be run from the same power source.

In addition, a lever operated cam is provided for locking the switch contacts in an on position or an off position, regardless of whether the switch operating mechanism is engaged against a button in the off or on positions, i.e. the automatic operation of the programmable timer may be overridden.

The programmable timer according to the invention herein may be manufactured from a relatively small number of parts, is rugged and reliable, and can be made for a cost which permits its use in home applications.

Other objects and features of the programmable timer according to the invention will in part be obvious and will in part appear from a perusal of the following description of the preferred embodiment and the claims, taken together with the drawings.

DRAWINGS

FIG. 1 is a front plan view of a programmable timer according to the invention herein;

FIG. 2 is a front plan view, partially cut away, of the programmable timer of FIG. 1;

FIG. 3 is an enlarged sectional view of the programmable timer of FIG. 1 taken along the lines 3—3 of FIG. 1;

FIG. 4 is an enlarged fragmentary view of the programmable timer of FIG. 1 showing the switch operating mechanism engaging a button in the on position, but with the switch contacts still open;

FIG. 5 is an enlarged fragmentary view of the programmable timer of FIG. 1 showing the switch mechanism engaged against a button in the on position, and with the switch contacts closed;

FIG. 6 is an enlarged fragmentary sectional view of the programmable timer of FIG. 1, similar to a portion of FIG. 3, and showing the switch contacts in their off position;

The same reference numerals refer to the same elements throughout the various Figures.

DESCRIPTION OF THE PREFERRED EMBODIMENT

Figure 7:
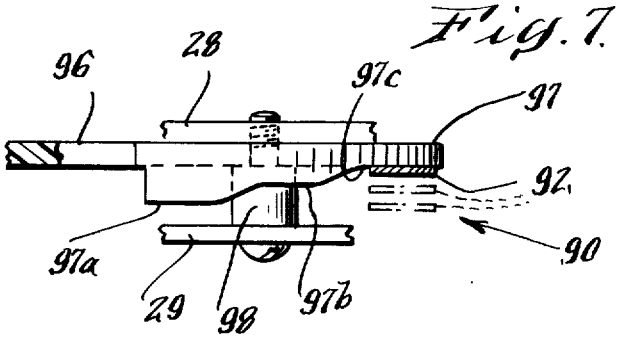
FIG. 7 is an enlarged fragmentary end view of a lever operated cam of the programmable timer of FIG. 1.

Referring to FIGS. 1-3, there is shown a programmable timer 10 according to the invention herein, the programmable timer 10 most generally comprising a housing 11 having a front panel 12, a rear panel 13, and sidewalls 14. Protruding from the back panel 13 is two-blade male plug 15, by which the programmable timer may be connected into a standard electrical outlet. On the front panel 12 is a female plug receptacle 16, into which a device such as a lamp or the like to be controlled by the programmable timer 10 may be plugged.

The programmable timer 10 next comprises a generally circular face plate 20 disposed on the front panel 12, and the face plate 20 has time indicating indicia displayed in a circle thereabout, as generally indicated at 21. In the embodiment shown, the indicia indicate a twenty-four hour period. Surrounding the hour indicating indicia are a plurality of buttons, such as buttons 30, 31 and 32. There are twenty-four buttons, i.e. one button for each hour interval, in the embodiment shown. The buttons respectively extend through a plurality of slots 22, and the buttons are individually selectively movable in the slots 22 between a radially outward off position illustrated by button 31, and a radially inward on position, illustrated by button 30.

With particular reference to FIGS. 2 and 3, the plurality of buttons are integrally connected by an equal plurality of flexible hinge members 38 to a hub 39, and the hub 39 is mounted to an intermediate cross panel 28 of the housing 11. The cross panel 28 may be stepped, as shown in FIG. 3, to accurately and quickly position the hub 39 thereon. The hub 39, hinge 38 and buttons 31-32 may be molded in one piece which is easily assembled despite the twenty-four individual buttons it comprises.

The face plate 20 comprises a downwardly extending bead or flange 23 about the radially inward edges of slots 22, and an upwardly extending bead or flange 24 about the radially outward edges of notches 22. The buttons each include an "on" notch, such as "on" notch **30*a* of button 30 which engages with the downwardly turned bead 23 to latch button 30 in its radially inward on position. The buttons further each include a second notch, such as notch 32*b* of button 32, which engages over the upwardly turned bead 24 to latch button 32** in the off position as shown.

As will be more fully discussed below, latching a button in its radially inward on position results in the device plugged into the programmable timer 10 being turned on for the approximate one hour period indicated by the indicia adjacent to the button, and if the next clockwise adjacent button is in the on position, the device will remain on for the next one hour period. However, if the next adjacent clockwise button is in the off position, the device will be turned off. Thus, the desired times for a device to be on and off are easily set by the user of programmable timer, and those times are readily ascertainable and understandably with reference to the fixed face plate and time indicating indicia thereon.

The programmable timer 10 further comprises an electric motor 50, mounted within housing 11 as seen in FIG. 3, and motor 50 derives its power from the terminals of male plug 15 when the programmable timer is plugged into an electrical outlet. The motor 50 drives a gear wheel 60, which is rotatably mounted in the housing plate 28 via a depending hollow stub shaft 61. The motor drives the gear wheel 60 through a gear train including gear 51 driven by the motor and connected to gear 52 which drives gear 53. A shaft 54 is mounted to the top of gear 53 by a one-way clutch device 55, and the opposite end of shaft 54 is provided with a spur gear 56 which drives the gear wheel 60.

The gear wheel 60 is disposed below the face plate 20, and is substantially concentric with it, and in particular, is concentric with the inside edges of the slots 22 which are arrayed in a circular pattern about the face plate 20. A central shaft 62 extends upwardly from the gear wheel 60 through the face plate 20, and a pointer 63 is mounted to the shaft 62. In the embodiment shown, the shaft 62 and pointer 63 rotate once every twenty-four hours, and the indicia 21 and pointer 63 indicate the time. It will be appreciated that other periods of rotation could be established by merely altering the gear ratios of gears 51, 52 or 53, with the time indicating indicia also altered appropriately.

The programmable timer 10 further generally comprises a switching mechanism 70, located generally under the face plate 20, and a switch assembly 90 located below the panel 28, all within the housing 11.

The switch assembly 90 first comprises a lower flexible spring blade 91, mounted at one of its ends to a flange 29 extending outwardly from the sidewall 14 of housing 11. The other free end of lower flexible spring blade 91 is disposed below the stub shaft 61 of the gear wheel 60. An upper flexible spring blade 92 is also mounted at one end to the flange 29, and the free end of the upper blade 92 is disposed above the lower blade 91. The two spring blades 91 and 92 have switch contacts 93 and 94, respectively, which complete an electrical circuit through the flexible spring blades when closed together. The upper and lower flexible spring blades 91 and 92 are connected by wires 95 such that the switch contacts make or break electrical contact between the male plug 15 on one side of the programmable timer 10 and the female plug receptacle 16 on the opposite side thereof, as will be readily understood although not shown in detail. Thus, a device such as a lamp which is plugged into the female plug receptacle 16 is turned on when the contacts 93 and 94 are closed together, and is turned off when the contacts 93 and 94 are open.

The switch assembly 90 further comprises an L-shaped lever 96, best seen in FIG. 2, the L-shaped lever 96 being pivotally mounted to the flange 29 at 98. One end of the L-shaped lever is positioned above the upper flexible spring blade 92 and the underside of the lever 96 is provided with a depending cam 97. The cam 97 is shown in an end view in FIG. 7, where it will be seen that the cam has a first deep level cam surface **97*a*, an intermediate surface 97*b* and a shallow surface 97*c*, connected by smooth transition portions. These three cam levels support the upper spring blade at one of three different levels, as indicated in FIG. 7. The opposite end of lever 96 is provided with upstanding arm 99 which extends through a three-position notch in the front panel 12, and is slideable in notch 27 between the three positions, which are "on", "automatic", and "off". The three positions correspond to the three cam levels 97*a*, 97*b* and 97*c* and the spring blade 92 is positioned on the intermediate level 97*b* when the arm 99 and lever 96** are in the central "automatic" position. In this position, the programmable timer operates to automatically turn devices on and off, as will be more fully described below.

The switching mechanism 70 of the programmable timer 10 comprises a switch rod 71, best seen in FIG. 3, which is slideably received in the depending stub shaft 61 of gear wheel 60. The switch rod has a pointed upper tip 72, and the lower end of the rod 71 is biased upwardly by the lower flexible spring blade 91. The upper end of the rod 71 butts against a cam bar 75 which is mounted for side-to-side sliding movement through a slot 68 in the shaft 62 above gear wheel 60. The cam bar 75 defines a first relatively deep notch 76, and when the rod 71 is received therein, it is displaced upwardly a sufficient distance to permit lower switch blade 91 to close its contact 93 against contact 94 of upper switch blade 92. With reference to FIG. 3, when the cam bar 75 is slid to the left, it cams the rod 71 downwardly, and the tip 72 of the rod 71 seats in a second, shallow notch 77 formed on the underside of the cam bar 75. When the rod 71 is received in the shallow notch 77, which is only deep enough to retain the cam bar 75 against inadvertent sliding movement, the lower spring blade 91 is displaced downwardly, as seen in FIG. 6, to separate the switch contacts 93 and 94. The cam bar 75 has an end stop 74, which prevents it from sliding too far to the left, as viewed in FIGS. 3 and 6.

The switch mechanism 70 further comprises means for driving the cam bar from side to side in order to open and close the switch contacts 93 and 94. In particular, the switching mechanism 70 further comprises a bell crank 80 which is pivotally mounted on a pin 64 extending upwardly from the gear wheel 60 near the periphery thereof. The bell crank 80 has an arm 81 at one end thereof which is received in and slides in a slot 78 formed in the cam bar 75. A hook 82 is formed on the opposite end of the bell crank 80, and a coil spring 84 is attached between the hook 82 and a pin 65 also upstanding from the gear wheel 60 near the shaft 62. Thus, the coil spring 84 tends to rotate the bell crank 80 in the clockwise direction. With reference to FIG. 4, when the spring 84 rotates the bell crank 80 in the clockwise direction, the arm 81 abuts against the radially outer end **78*a* of the slot 78 in the cam bar 75, positioning the cam bar 75 to hold the rod 71 in its down position to open switch contacts 93 and 94**, as shown in FIG. 3.

The bell crank 80 has a somewhat L-shaped appearance when viewed in plan, with an outer corner 86 between the arm end 81 and hook end 82. The bell crank 80 has a leading edge surface 85 extending from the corner 86 and toward the hook end 82.

The operation of the switching mechanism 70 of the programmable timer 10 is as follows. As described above, gear wheel 60 rotates in the clockwise direction, and the bell crank 80 mounted to pin 64 protruding upwardly from the gear wheel 60 also rotates in the clockwise direction with the gear wheel 60. This rotation should not be confused with rotation of bell crank 80 about its mounting pin 64.

Referring first to FIG. 4, when the bell crank 80, rotating with gear wheel 60, passes buttons which are positioned in their radially outward off position, then no engagement between the buttons and the bell crank 80 occurs. Thus, the bell crank 80 is in its clockwise rotated position on pin 64, and the bar cam 75 is slid radially outwardly with its stop 74 engaged against the shaft 62. As shown in FIG. 6, when the cam bar is in this position, the tip 72 of pin 71 is received in the shallow notch 77, wherein the rod 71 is displaced downwardly to separate the switch contacts 93 and 94. Thus, no power is supplied to the female plug receptacle 16.

Referring again to FIG. 4, as the gear wheel 60 and the bell crank 80 mounted thereon rotate in a clockwise direction toward a button which is in its radially inwardly on position, such as button 30 in FIG. 4, the leading edge 85 of the bell crank 80 contacts the button 30. By comparing FIG. 4 and FIG. 5, it will be seen that as the gear wheel 60 continues to rotate, the bell crank 80 is rotated in a counterclockwise direction about pin 64. Thus, the arm end 81 of the bell crank 80 moves radially inwardly in the slot 78 of cam bar 75 until the arm 81 engages the cam bar 75 at the radially inner end 78*b* of slot 78. An incremental further counterclockwise rotation of the bell crank 80 about pin 64 drives the cam bar 75 through the shaft 62, and thereby displaces the tip 23 of the rod 71 from the shallow notch 77. As the cam bar slides from left to right, as viewed in FIG. 6, the tip 72 of the rod 71 will be presented to the deep notch 76, at which time the cam bar 75 will move quickly to the position shown in FIG. 3, i.e. the seating of the rod 71 in the notch 76 serves to move the cam bar 75 quickly from left to right, the left to right direction being applicable to the Figures, as shown. Since the notch 76 is deeper than the notch 77, the rod 71 moves rapidly upward under the spring bias force produced by the lower spring blade 91, this rapid movement closing the switch contacts 93 and 94 in a desirable snap action manner.

With reference to FIG. 2, when the cam bar and the rod 71 slide to close the switch contacts as described above, the arm 81 of the bell crank 80 remains relatively stationary, and the movement of the cam bar 75 with respect to arm 81 is accommodated by the slot 78. The arm end 81 is then positioned near the radially outer end 78*a* of the slot 78. It will be noted that the coil spring 84 is substantially stretched by the counterclockwise rotation of bell crank 80 about pin 64, and thus the bell crank 80 is biased to rotate in a clockwise direction as soon as it is released from the pin 30. Therefore, as the gear wheel 60 rotates a sufficient amount such that the bell crank 80 is past the button 30, the bell crank 80 rotates rapidly in a clockwise direction, driving the cam bar sharply from right to left, and from the position shown in FIG. 3 to the position shown in FIG. 6. This displaces the rod 71 downwardly, seating it in shallow notch 77, and opens the switch contacts 93 and 94, also in a desirable snap action manner.

If the next clockwise adjacent button, e.g. button 31 following button 30, is in its on position, the clockwise rotation of bell crank 80 about pin 64 is prohibited by its engagement with that next button, and the switch mechanism 70 maintains the switch contacts closed. The geometry and sizing of the bell crank and buttons is such that the switch mechanism maintains the switch contacts closed for a period of approximately one full hour as the switch mechanism 70 passes any button in the on position.

Figure 9:
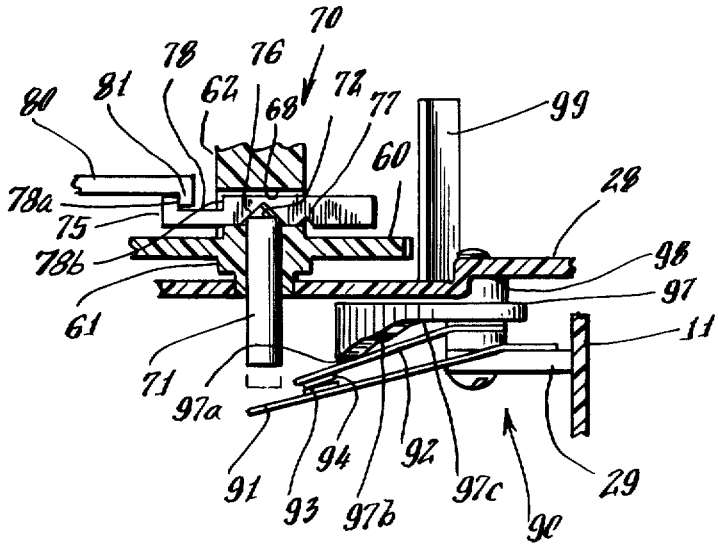
FIG. 9 is an enlarged fragmentary view of the programmable timer of FIG. 1 showing the cam of FIG. 7 holding the switch contacts in positive on position.

For the above discussion of the operation of the switch mechanism 70, the L-shaped lever arm 96 together with its control rod 99 were in their central position, indicated by "auto" in FIG. 1. In that position, the upper spring blade 92 is held on the cam surface 97*b* at an intermediate level wherein upward and downward displacement of the rod 71 acting with the lower spring blade 91 will open and close the switch contacts 93 and 94. However, it is desirable to be able to override the automatic operation of the programmable timer 10 in order to switch an appliance plugged into it to an on or off condition without resetting the buttons. This is accomplished by the cam 97 and the L-shaped lever 96 and the control arm 99, and in particular, moving the control arm 99 to the on position shown in FIG. 1 rotates the L-shaped lever 96 and the cam 97 such that the upper spring blade 92 rests against cam surface 97*a*. As shown in FIG. 9, this displaces the upper flexible spring blade 92 substantially downwardly into engagement with the lower blade 91, whereby the switch contacts 93 and 94 are closed. The switch contacts 93 and 94 remain closed even if the rod 71 is displaced downwardly, which would otherwise open the switch contacts, and the power is maintained to female plug receptacle 96.

Figure 8:
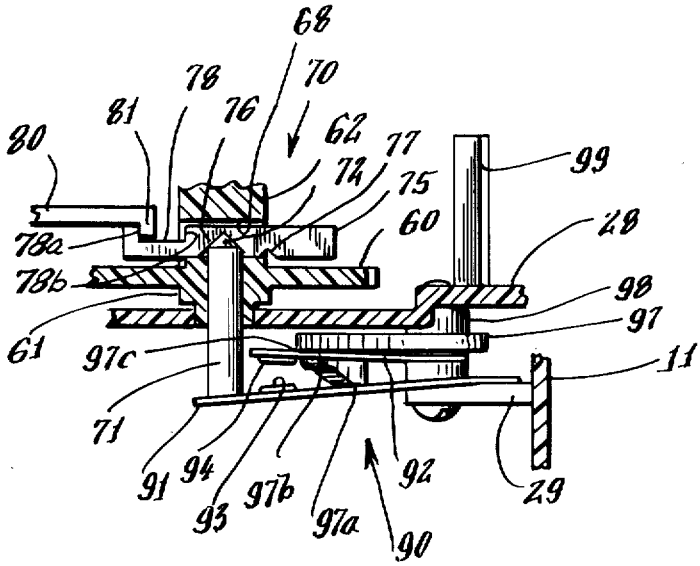
FIG. 8 is an enlarged fragmentary view of the programmable timer of FIG. 1 showing the cam of FIG. 7 holding the switch contacts in positive off position.

If it is desired to turn an appliance off, thus overriding the automatic operation of the programmable timer 10, the lever 99 is moved to the "off" position, which rotates the lever 96 and cam 97 such that the upper contact blade 92 rests against cam surface 97*c*. In this position, the upper spring blade 92 is displaced upwardly, and cannot be contacted by the lower blade 91 such that the contacts 93 and 94 would close, even if the rod 91 is in its upwardly displaced position. This is illustrated in FIG. 8.

The programmable timer described above admirably achieves the objects of the invention. It is easily programmed by merely setting buttons in their in or out positions, and it is readily understood because the buttons are adjacent stationary indicia clearly indicating the times at which the device will be on or off. Similarly, the programmable timer clearly indicates the current time of day by the pointer rotating in clock-like fashion, and if it is necessary to correct the time of day, this can be accomplished very simply by rotating the pointer. The programmable timer offers great flexibility in controlling devices such as lamps or the like, in that the devices may be turned off and on several times a day, and may be left on or off for substantial intervals, as desired and selected. The programmable timer, and particularly the switch mechanism and the on/off button assembly, are constructed of simple, inexpensive parts, which are easily assembled and yet result in a reliable unit.

It will be appreciated that various changes and modifications may be made from the preferred embodiment described above. In particular, the period of rotation of the pointer and switching mechanism may be altered such that the programmable timer has a cycle of, e.g., twelve hours, or even a single hour. This would provide for more frequent on/off transitions for the device controlled by the programmable timer, with a shorter duration of each on/off cycle, and could be easily accomplished by modifying the gear ratios through which the motor drives the shaft, pointer and switching mechanism. The number of buttons can also be altered to provide more or less on/off transitions per full revolution cycle, and the size of the buttons and their relationship to the switching mechanism can be altered to provide for different duration of the individual on or off periods established by the buttons. The particular means for latching the buttons in their off or on positions can be altered, and the switch mechanism could be altered to be normally on instead of normally off. Other changes and modifications will be apparent to those skilled in the art, and may be made without departing from the spirit and scope of the invention, which is limited only by the following claims.

I claim:

1. A programmable timer for selectively controlling the operation of an electrically operated device, such as a lamp, the programmable timer comprising:

(a) a housing and means mounted on the housing for connecting the programmable timer to a source of electrical power;

(b) a plurality of buttons arrayed in a circle on the housing, each of the plurality of buttons movable between and releasably positionable in a first radially inward position and a second radially outward position;

(c) a shaft rotatably mounted in the housing and centrally positioned with respect to the plurality of buttons, the shaft rotated by a motor mounted in the housing and driven by the source of electrical power;

(d) a cam bar mounted for radial sliding movement in a slot defined through the shaft, the cam bar defining a cam notch axially disposed with respect to the shaft, the cam bar slidable to position the cam notch on and spaced apart from the axis of the shaft;

(e) a rod axially slidably mounted in the shaft and spring biased against the cam bar, the rod slidable between a first position seated in the cam bar notch and a second, axially displaced position butting against the cam bar and out of the cam bar notch, wherein sliding movement of the cam bar cams the rod out of the cam bar notch to its second position;

(f) switch means operated by axial movement of the rod between its first and second positions;

(g) means mounted on the housing for electrically connecting an electrically-operated device to the programmable timer, said means electrically-connected through the switch means to the means for connecting the programmable timer to a source of electrical power, wherein the switch means turns the electrically-operated device on and off;

(h) a bell crank rotatably mounted on a supporting member extending radially from the shaft toward the buttons, the supporting member rotating with the shaft and moving the bell crank along the circularly arrayed buttons, the bell crank including a leading edge which engages buttons in their radially inward position thereby rotating the bell crank in a first direction, the bell crank spring biased to rotate in the opposite direction when it disengages from a button in its radially inward position, the bell crank having means engaging said cam bar to move said cam bar such that the cam notch is located on the axis of the shaft when the bell crank is rotated in its first direction and to move said cam bar such that the cam notch is spaced apart from the axis of the shaft when the bell crank is rotated in its opposite direction, whereby the switch means may be operated through the rod.

2. A programmable timer as defined in claim 1 wherein the switch means comprises a first switch contact mounted for movement with the rod into and out of contact with a second switch contact mounted to the housing.

3. A programmable timer as defined in claim 2 wherein the switch means further comprises a first flexible spring blade one end of which is mounted to the housing and the free end of which engages the end of the rod opposite the cam bar and spring biases the rod toward the cam bar, and the first switch contact is mounted to the flexible spring blade for movement into and out of contact with the second switch contact.

4. A programmable timer as defined in claim 3 wherein said second switch contact is mounted on a second flexible spring blade having one end mounted to the housing and the other free end adjacent the rod with the switch contacts juxtaposed, wherein upward motion of first flexible spring blade with the rod moves the first switch contact toward the second switch contact, the further comprising selector means for selectively positioning the second flexible spring blade (1) in a first position supporting the second flexible spring blade with the first and second switch contacts closed and disengaging the first flexible spring blade from the rod, thus overriding the switch operating motion of the rod to maintain the switch contacts closed, (2) in a second position wherein the switch operating motion of the rod moves the second switch contact in and out of contact with the first switch contact, and (3) in a third position with the second switch contact sufficiently spaced apart from the first switch contact that the switch operating motion of the rod does not close the switch contacts, thus overriding the switch operating motion of the rod to maintain the switch contacts open.

5. A programmable timer as defined in claim 4 wherein the selector means comprises a cam having a three-level cam surface against which the second flexible spring blade biases itself, the three levels of the cam surface selectively supporting the second flexible spring blade in the three positions, wherein the cam is mounted on a rotatably mounted lever such that rotation of the lever selects one of the three cam surfaces, and the lever has an arm extending through the housing for rotating the lever, and the housing defines three notches for releasably receiving the lever in the three positions.

6. A programmable timer as defined in claim 2 wherein the tip of the rod butting against the cam bar is pointed to seat quickly into the cam notch, thereby sliding the cam bar to operate the switch means in a snap action manner, and the bell crank is loosely engaged in a slot in the cam bar such that the cam bar is free to slide quickly as the rod seats in the cam notch, and the spring bias on the bell crank is sufficiently strong to drive the cam bar and cam the rod out of the cam notch quickly, also operating the switch in snap action manner.

7. A programmable timer as defined in claim 6 wherein the bell crank is spring biased by a coil spring mounted to the bell crank and to the supporting member, and the coil spring is stretched by rotation of the bell crank upon the bell crank engaging a button in the radially inward position.

8. A programmable timer as defined in claim 1 wherein the plurality of buttons is each connected by a resilient hinge member to a common hub, whereby the buttons, hinge members and hub comprise a one-piece assembly, and the hub is mounted to the housing.

9. A programmable timer as defined in claim 8 wherein the housing further comprises a face plate defining a plurality of slots equal to the number of buttons, and the buttons are mounted to extend through the slots whereby the buttons extend beyond the face plate for manual manipulation between their radially outward and radially inward positions, and the bell crank rotates in a plane below the face plate and engages buttons in their radially inward position.

10. A programmable timer as defined in claim 9 wherein the shaft extends through the face plate and further comprising a pointer mounted to the shaft for rotation therewith and time indicating indicia arrayed about the face plate for cooperating with the pointer to indicate time.

11. A programmable timer as defined in claim 10 wherein the plurality of buttons and slots is twenty-four buttons and slots, equally spaced about the face plate.

12. A programmable timer as defined in claim 11 wherein the shaft rotates once every twenty-four hours.

13. A programmable timer as defined in claim 9 wherein each slot terminates in a flange at its radially inner edge and a flange at its radially outer edge, and each button comprises a slot on its radially inner edge and a slot on its radially outer edge, the slots selectively receiving the flanges to releasably hold the button in its radially inward and radially outward positions.

14. A programmable timer as defined in claim 1 wherein the means for connecting the programmable timer to a source of electrical power is a male plug extending outwardly from the housing and the means for connecting the device to the programmable timer is a female plug receptacle mounted on the housing.

15. A programmable timer as defined in claim 1 wherein the cam bar defines a shallow retaining notch spaced from the cam notch, the retaining notch receiving the rod when the rod is in its second axially displaced position butting against the cam bar.

16. A programmable timer for selectively controlling the operation of an electrically operated device such as a lamp, the programmable timer comprising:

(a) a housing, (b) male plug means extending from the housing for connecting the programmable timer to a source of electrical power;

(c) female plug means mounted to the housing for connecting the electrically operated device to the programmable timer;

(d) a face plate mounted to the housng, the face plate defining a plurality of slots arrayed in a circle and equally spaced apart;

(e) a plurality of buttons equal to the number of slots, the buttons each extending through one of the slots, the buttons each connected to a hub by a resilient hinge member wherein the buttons, resilient hinge members and hub comprise a one-piece assembly which is mounted to the housing below the face plate, the buttons manually selectively movable between and releasably positionable in a first radially inward position and a second radially outward position;

(f) a shaft rotatably mounted in the housing and centrally positioned with respect to the plurality of slots and buttons, the shaft rotated by a motor mounted in the housing and driven by the source of electrical power;

(g) a cam bar mounted for radial sliding movement in a slot defined through the shaft, the cam bar defining a cam notch axially disposed with respect to the shaft, the cam bar slidable to position in the cam notch on and spaced apart from the axis of the shaft;

(h) a rod axially slidably mounted in the shaft and having one end extending from the shaft, the rod slidable between a first position seated in the cam bar notch and a second axially displaced position butting against the cam bar and out of the cam bar notch, wherein sliding movement of the cam bar cams the rod out of the cam bar notch to its second position;

(i) switch means comprising a first flexible spring blade mounted at one end to the housing and having its free end engaged against the end of the rod opposite the cam bar to spring bias the rod against the cam bar, the flexible spring blade having a switch contact mounted thereon and a second juxtaposed switch contact, the axial sliding movement of the rod opening and closing the switch contacts to turn the device off and on by supplying power to the female plug; and (j) a bell crank rotatably mounted on a supporting member extending radially from the shaft toward the buttons, the support member rotating with the shaft and moving the bell crank along the circularly arrayed buttons, the bell crank including a leading edge which engages buttons in their radially inward position thereby rotating the bell crank in a first direction, the bell crank spring biased to rotate in the opposite direction when it disengages from a button in its radially inward position, the bell crank having means engaging said cam bar to move said cam bar such that the cam notch is located on the axis of the shaft when the bell crank is rotated in its first direction and to move said cam bar such that the cam notch is spaced apart from the axis of the shaft when the bell crank is rotated in its opposite direction, whereby the switch means may be operated through the rod.

* * * * *